US005697834A

United States Patent [19]

Heumann et al.

[11] Patent Number: 5,697,834

[45] Date of Patent: Dec. 16, 1997

[54] REMOTE REPAIR APPLIANCE

[75] Inventors: Frederick K. Heumann; Jay C. Wilkinson, both of Ballston Spa; David R. Wooding, Saratoga Springs, all of N.Y.

[73] Assignee: The United States of America as represented by the United States Department of Energy, Washington, D.C.

[21] Appl. No.: 682,468

[22] Filed: Jul. 17, 1996

[51] Int. Cl.[6] ..... B24B 19/00

[52] U.S. Cl. ..... 451/440; 451/347

[58] Field of Search ..... 451/430, 440, 451/9, 455, 451, 452, 150, 211, 141, 347

[56] References Cited

U.S. PATENT DOCUMENTS 5,022,192 6/1991 Nachbar .

5,577,954 11/1996 Okumura et al. ..... 451/347

FOREIGN PATENT DOCUMENTS 405245746 9/1993 Japan ..... 451/440

*Primary Examiner*—Robert A. Rose

*Assistant Examiner*—George Nguyen

*Attorney, Agent, or Firm*—Virginia B. Caress; William R. Moser; Paul A. Gottlieb

[57] ABSTRACT

A remote appliance for supporting a tool for performing work at a worksite on a substantially circular bore of a workpiece and for providing video signals of the worksite to a remote monitor comprising: a baseplate having an inner face and an outer face; a plurality of rollers, wherein each roller is rotatably and adjustably attached to the inner face of the baseplate and positioned to roll against the bore of the workpiece when the baseplate is positioned against the mouth of the bore such that the appliance may be rotated about the bore in a plane substantially parallel to the baseplate; a tool holding means for supporting the tool, the tool holding means being adjustably attached to the outer face of the baseplate such that the working end of the tool is positioned on the inner face side of the baseplate; a camera for providing video signals of the worksite to the remote monitor; and a camera holding means for supporting the camera on the inner face side of the baseplate, the camera holding means being adjustably attached to the outer face of the baseplate. In a preferred embodiment, roller guards are provided to protect the rollers from debris and a bore guard is provided to protect the bore from wear by the rollers and damage from debris.

18 Claims, 4 Drawing Sheets

REMOTE REPAIR APPLIANCE

BACKGROUND OF THE INVENTION

1. Field of the Invention

The present invention relates generally to equipment for effecting remote repairs to a substantially circular inner profile or bore of a workpiece and more particularly to such equipment that includes a video camera for viewing the worksite while the work is in progress.

The invention was made under a contract with the U.S. Department of Energy.

2. The Prior Art

In situ repairs to the bore of a workpiece, such as grinding operations carried out on the inside of a pipe, cylinder or valve, are often very difficult to effectuate because the repair location is visually restricted even though it may be accessible by hand. Several devices have been developed previously to deal with such repairs, including a device of the type disclosed in U.S. Pat. No. 5,022,192, to Nachbar et al. These previously developed devices suffer from several disadvantages, such as the build up of grinding particles on both the bore surface and rollers which causes marring and obstruction to movement of the device. Further, the boroscopic fiberoptics using fiber bundles which are employed in the Nachbar et al. device are subject to twisting as the device is rotated, resulting in a loss of focus in the video signal and damage to the fiber bundle.

SUMMARY OF THE INVENTION

The remote appliance of the present invention has several features which overcome drawbacks of previously developed devices. The appliance includes rollers which fit inside the bore of the workpiece and which are adjustably attached to the inner face of a baseplate of the appliance. These rollers allow the appliance to revolve about the mouth of the bore of the workpiece. A tool is supported by a tool holding means which is adjustably attached to the outer face of the baseplate. An opening in the baseplate allows the working end of the tool to project through the baseplate to the inner face side thereof. A camera, preferably a charged couple device (CCD) camera, is positioned on the inner face side of the baseplate by a camera holding means. The position of the camera is adjustable from the outer face side of the baseplate. A light means, preferably in the form of an illuminated fiber optic light guide, is positioned so as to illuminate the worksite in front of the camera. In use, the video signal from the camera is fed back to a remote monitor. In a preferred embodiment, the positions of the tool, the camera, and the rollers may all be adjusted from the outer face side of the baseplate so that the adjustments may be effectuated while the appliance is in the working position thereof within the bore of the workpiece.

The present invention includes several features for increasing efficiency and providing protection for the workpiece. Preferably, roller guards are provided for protecting the rollers from debris, thereby allowing the rollers to roll more efficiently while inhibiting debris from being trapped between the rollers and the bore. Advantageously, further means for protecting the bore of the workpiece from damage are also provided. In a preferred embodiment, a means for protecting the bore comprises a bore guard which fits inside the bore of the workpiece to protect the bore from debris and roller damage. The bore guard preferably includes a lip portion which lies flat against the workpiece at the mouth of the bore to protect the workpiece from damage due to debris and wear caused by the rotation of the baseplate. Preferably, the bore guard is made from thin steel and may be replaced after use.

Several different types of tools may be attached to the appliance including a drill motor, a vacuum, an impact wrench, a sprayer, a welding torch, a welding gun, or an inspection device. If an air motor or even an electric motor is used, a number of working attachments are preferably powered therefrom including a grinding wheel, a cutting wheel, a sanding or flapper wheel, or a buffer wheel. Preferably, the air motor will have rear exhaust so that worksite interference from grinding dust and other debris will be minimized. This will also aid the camera to provide a clearer video of the worksite.

Before use, initial adjustments are made to the appliance so that the roller positions, tool position, and camera position are as dose as possible to the requirements of the job. Then, the bore guard is placed in position in the bore of the workpiece and the appliance is positioned against the bore guard. Further adjustments are then made to the appliance. Once in position, the working attachment, which is a grinding wheel in the preferred embodiment, is used to grind the walls of the bore. The appliance is advantageously rotated or revolved around the bore while the rollers maintain the grinding wheel in the same radial position with respect to the bore. The light means illuminates the worksite for the CCD camera which provides a video signal to a remote monitor for viewing by the operator so the operator has visual feedback.

Other objects, features, and advantages of the present invention will be set forth in, or will become apparent from, the detailed description of the preferred embodiments of the invention which follows.

DESCRIPTION OF THE PREFERRED EMBODIMENTS

Figure 1:
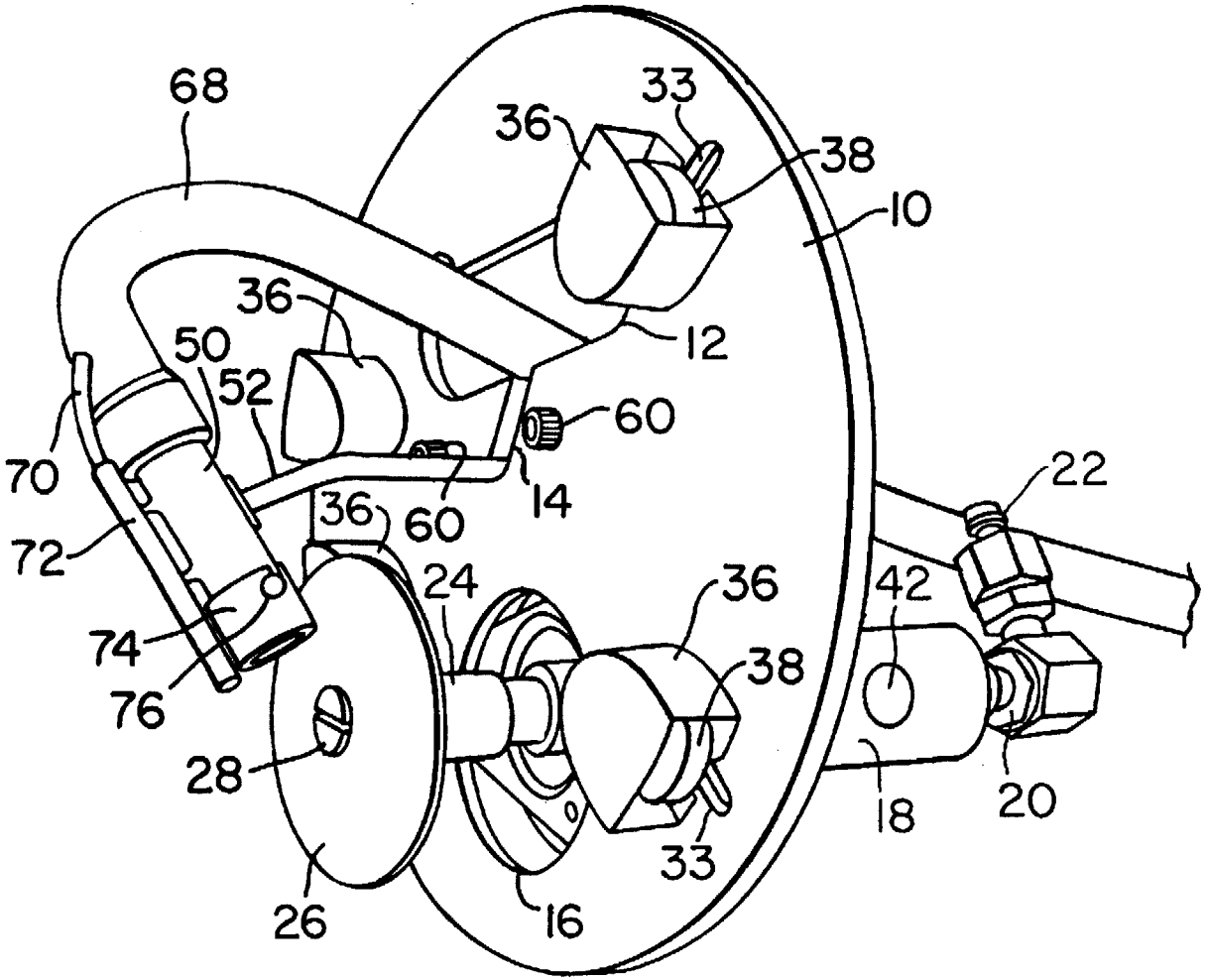
FIG. 1 is a perspective view of one embodiment of the present invention in which the tool provided is a grinder.
Figure 2:
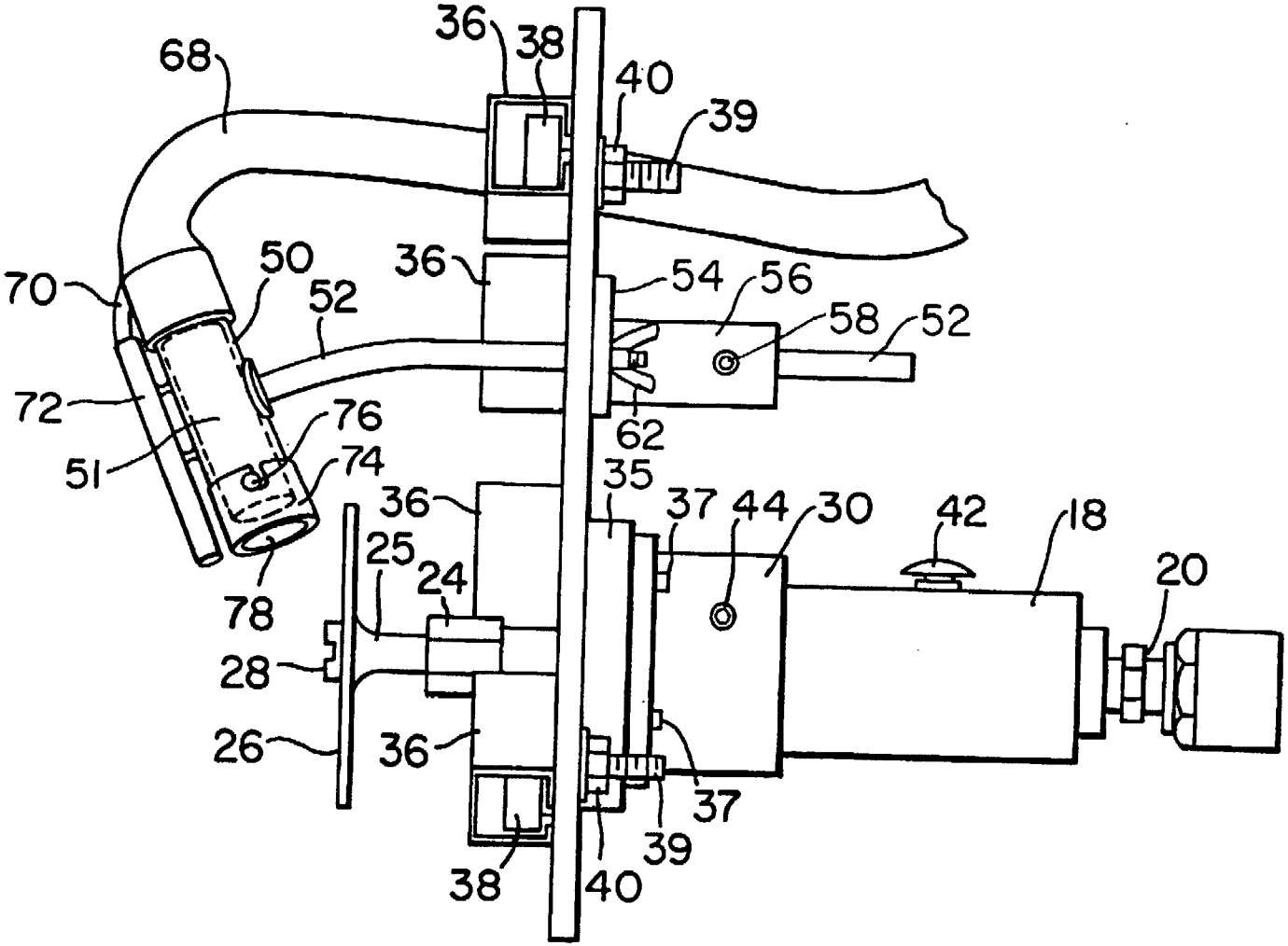
FIG. 2 is a side elevational view of the embodiment of the present invention shown in FIG. 1.
Figure 3:
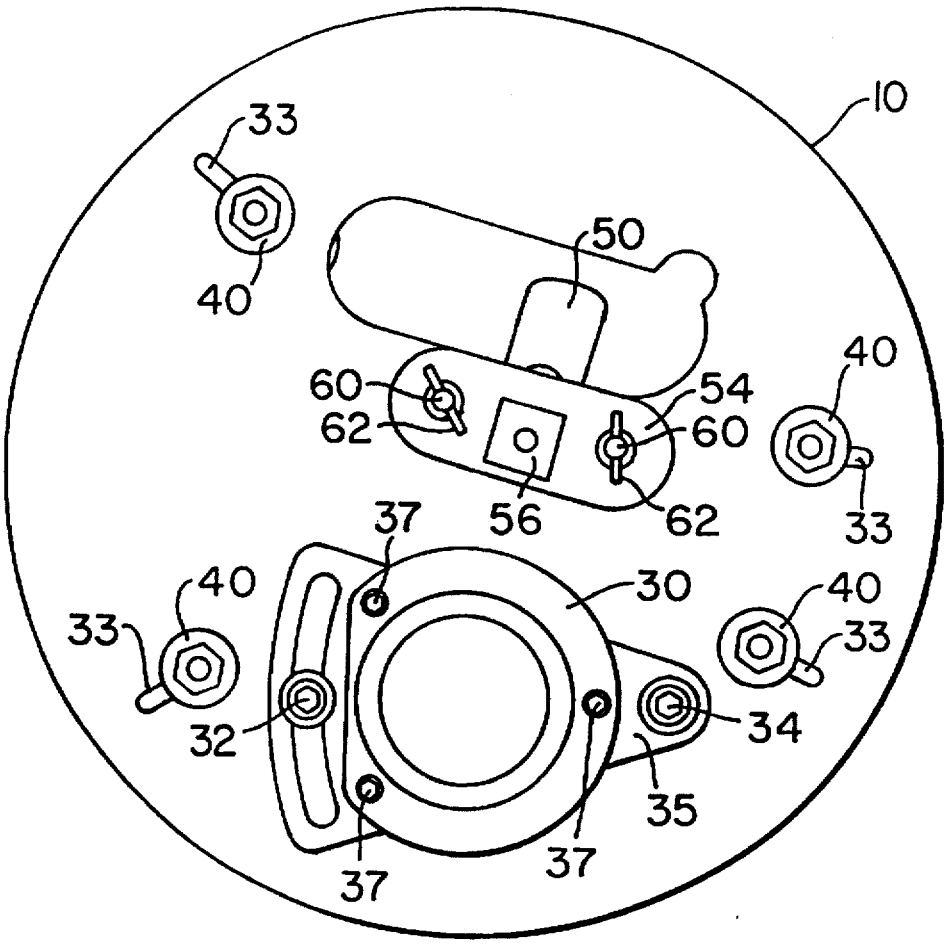
FIG. 3 is a rear elevational view of the embodiment shown in FIG. 1 with the grinding tool and the camera and its associated cables removed.

Referring to the drawings in which like numerals represent corresponding elements throughout the several views and, in particular, to FIGS. 1 through 3, an appliance in accordance with the present invention includes a baseplate 10 having a circular profile and made from ¼ inch thick aluminum. As best seen in FIG. 3, a camera mount 56 having mounting plate 54 is mounted to baseplate 10 with bolts 60 and wing nuts 62. A support post 52 protrudes from camera mount 56 through an elongated slot 14 in baseplate 10 and is adjustably secured to camera mount 56 with a set screw 58 (shown in FIG. 2). A camera tube 50, which contains a CCD camera 51 (shown in dotted lines in FIG. 2), is connected to the distal or protruding end of post 52. A lens holder 74, which holds a protective lens 78 (FIG. 2), is removably attached to the free end of camera tube 50 with a bayonette-type connection in conjunction with pin 76. A light tube 72 is mounted to camera tube 50 along one side thereof in parallel relation thereto. Light tube 72 holds a fiber optic light guide 70 such that fiber optic light guide 70 illuminates the area in front of CCD camera 51. Protective tubing 68, which protects fiber optic light guide 70 and the video cable (not shown) associated with CCD camera 51 from debris, extends through an opening 12 in baseplate 10 to the back side of baseplate 10 where fiber optic light guide 70 is illuminated with a remote light source (not shown) and the video cable is connected to a remote monitor (not shown). Preferably, the video cable is connected to CCD camera 51 via a quick disconnect type connector.

As best seen in FIGS. 2 and 3, a tool collar 30 is mounted to a tool collar baseplate 35 with screws 37. As shown in FIG. 3, tool collar baseplate 35 is pivotally mounted to baseplate 10 via a pivot bolt 34 and an adjustment bolt 32 such that tool collar 30 aligns with round hole 16 in baseplate 10. Although many different tools may be mounted in the appliance, in the embodiment shown, an air motor 18, capable of approximately 20,000 rpm and having rear exhaust and a throttle lock 42, is adjustably mounted in tool collar 30 and secured in place by a set screw 44. In conventional manner, a screw 28 (FIGS. 1 and 2) mounts a grinding wheel 26 on a shank 25, and shank 25 is affixed to the rotary drive or output shaft of air motor 18 via a collet 24. Air is provided to air motor 18 via a 360 degree swivel connection 20 and a quick release connector 22.

Four rollers 38 are adjustably mounted to baseplate 10 in circumferentially spaced relation near the circular periphery of baseplate 10 using hex-head bolts 39 and nuts 40. The hex-head bolts 39 are inserted through slotted holes 33 (FIG. 3) in baseplate 10. The major axes of slotted holes 33 projects radially so that the positions of rollers 38 can be adjusted radially to fit or match different diameters of workpiece bores. Each roller is protected from debris via a roller guard 36 (FIGS. 1 and 2) made from 20 gauge stainless steel. As the appliance is rotated with respect to a workpiece, roller guards 36 sweep the bore ahead of the rollers to prevent debris from getting under the rollers.

Figure 4:
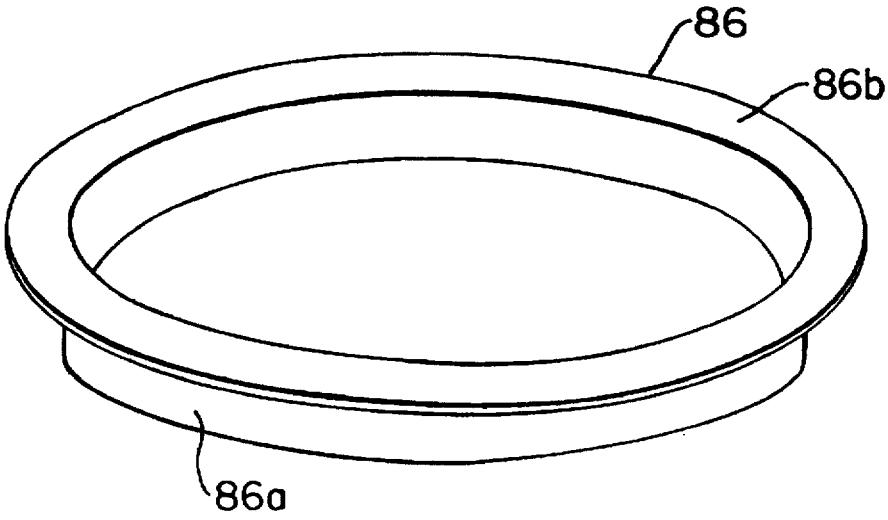
FIG. 4 is a perspective view of a bore guard which is provided in accordance with a preferred embodiment of the invention and which is used in conjunction with the embodiment shown in FIG. 1 (as shown in FIG. 5).

Referring to FIG. 4, a bore guard 86 is shown which is advantageously used in conjunction with the embodiment of FIG. 1. In the illustrated embodiment, bore guard 86, which is preferably made out of 20 gauge stainless steel, has a thin metal band portion **86*a* which fits tightly inside the bore of a workpiece to protect the inside surface of the bore from damage due to rollers 38 or debris. Attached to the band portion 86*a* is a lip portion 86*b* which protects the edge of the workpiece surrounding the bore (for example, a valve seat) and also properly locates band portion 86*a*** with respect to the bore.

Figure 5:
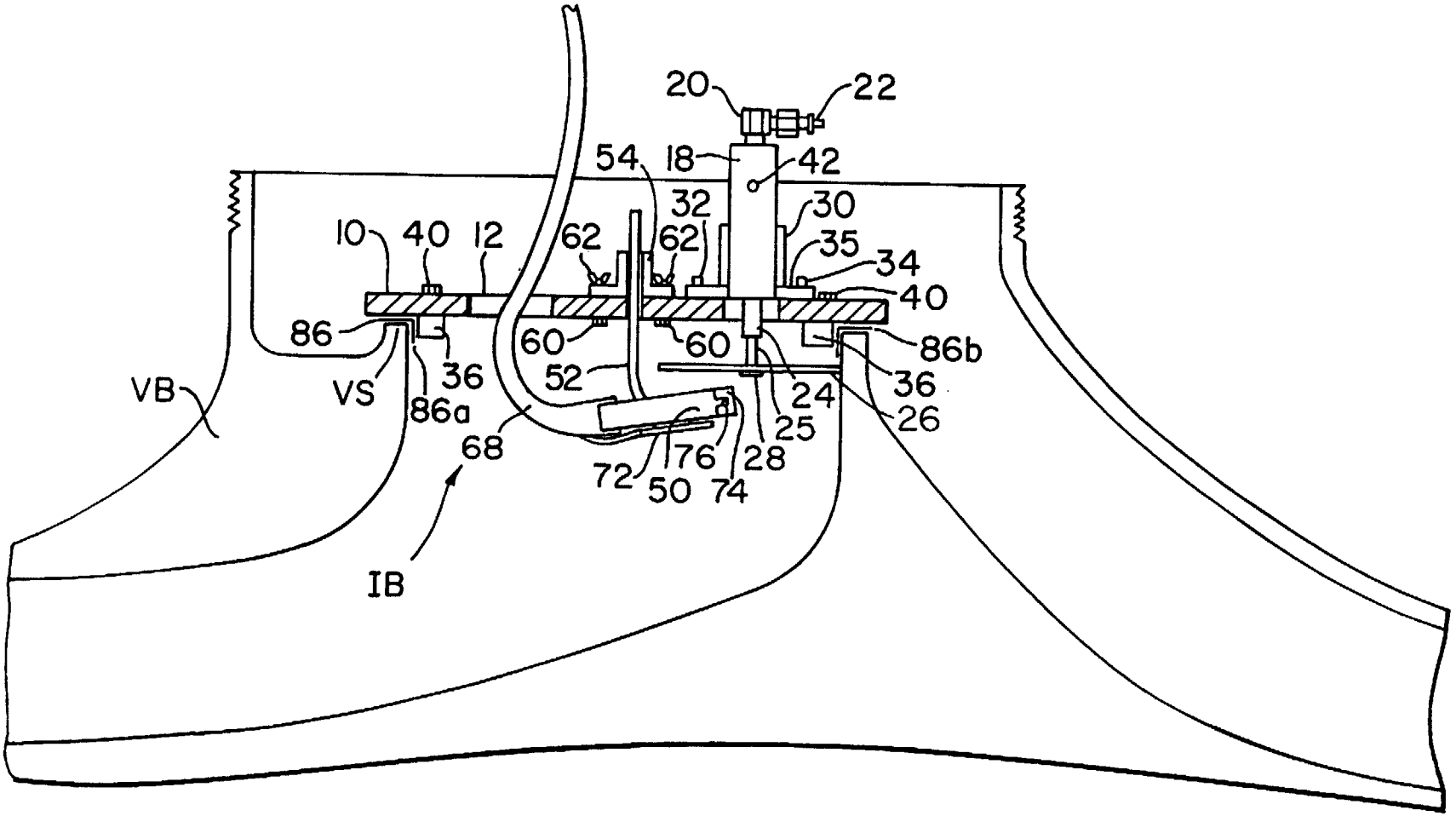
FIG. 5 is a cross-sectional side elevational view of the embodiment of FIG. 1 and the bore guard of FIG. 4 in use on a valve.

Referring to FIG. 5, the appliance of FIG. 1 and the bore guard of FIG. 4 are shown in use mounted on a valve body VB with the valve bonnet removed. Bore guard 86 is shown placed over the valve seat VS of valve body VB and it protects the inside bore IB of the valve from wear from rollers 38 (which are hidden by roller guards 36 in FIG. 5) and from damage from debris. Bore guard 86 is shown loosely fitting within bore IB of valve body VB to more clearly show the placement thereof. However, in actual use, bore guard 86 would fit tightly inside the bore and between baseplate 10 and valve seat VS. Baseplate 10 rests on lip **86*b* of bore guard 86 which is supported by the valve seat VS. Either before use or during use, the appliance is adjusted so that grinder wheel 16 will be in contact with the portion of the valve bore needing repair. As grinding is performed, the appliance is rotated with respect to bore IB so that other portions of the valve bore may be ground. Rollers 38 maintain grinding wheel 26 at the predetermined radial position with respect to bore IB as the appliance is rotated. By using the video information as provided by CCD camera 51, the position of air motor 18 may be adjusted without removing the appliance from the valve body. Such adjustment may be necessary as grinding wheel 26 wears or in order to raise or lower the grinding wheel 26** with respect to bore IB.

As noted above, there are several adjustments provided for in the illustrated embodiment. Grinding wheel 26 may be adjusted transversely with respect to baseplate 10 by sliding air motor 18 within tool collar 30 and locking it in place with set screw 44. Also, grinding wheel 26 may be adjusted in a plane parallel to baseplate 10, such that grinding wheel 26 may be moved toward or away from the periphery of baseplate 10. This is achieved by pivoting tool collar baseplate 35 at pivot bolt 34 and locking tool collar baseplate 35 in place with adjustment bolt 32. Of course, further adjustments in this regard may be effected by replacing grinding wheel 26 with an alternate grinding wheel having a different thickness or diameter.

Camera tube 50 which houses CCD camera 51 may be adjusted so that it is directed at the worksite by rotating or otherwise adjusting support post 52 with respect to camera mount 54 and locking support post 52 in place with set screw 58.

Further, as noted above, the positions of rollers 38 and roller guards 36 with respect to the periphery of baseplate 10 may be adjusted radially to fit bores of various diameters. Each of the rollers 38 may be adjusted while the appliance is in place by holding hex-head bolt 39 with a hex wrench and tightening nut 40 with a open end wrench. While adjustments may be easier if made before the appliance is placed within the bore of the workpiece, the location of the adjustment mechanisms make further adjustments possible once the appliance is in the working position. The video information from CCD camera 51 assists in this regard. If rollers 38 and roller guards 36 are to be adjusted before the appliance is placed within the bore of the workpiece, bore guard 86 may be placed onto the appliance for reference.

Although the invention has been described in detail with respect to preferred embodiments thereof, it will be apparent to those skilled in the art that variations and modifications can be effected in these embodiments without departing from the spirit and scope of the invention.

What is claimed is:

1. A remote appliance for supporting a tool having a working end for performing work at a worksite on a substantially circular bore of a workpiece and for providing video signals of the worksite to a remote monitor, said bore having a mouth, said remote appliance comprising:

a baseplate having an inner face and an outer face and being adapted to be positioned against the mouth of the bore;

a plurality of rollers, each of said rollers being rotatably and adjustably attached to said inner face of said baseplate and being positioned so as to roll against the bore of the workpiece when said baseplate is positioned against the mouth of the bore so as to enable Said appliance to be rotated about said bore in a plane substantially parallel to said baseplate;

a bore protection means for protecting the bore from debris generated by said appliance and from marring by said plurality of rollers;

a tool holding means, adjustably attached to said outer face of said baseplate, for supporting the tool such that the working end of the tool is positioned inwardly of said inner face of said baseplate;

a camera for providing video signals of the worksite to the remote monitor; and a camera holding means, adjustably attached to said outer face of said baseplate, for supporting said camera inwardly of said inner face of said baseplate.

2. A remote appliance as in claim 1, further comprising a plurality of roller guards mounted on said baseplate, each of said roller guards surrounding a respective one of said plurality of rollers so as to protect said respective one of said rollers from debris generated by said appliance and being positioned to sweep said debris ahead of said respective one of said rollers as said respective one of said rollers rolls against the bore.

3. A remote appliance as in claim 1, further comprising a light means for illuminating the worksite.

4. A remote appliance as in claim 3, wherein said light means comprises a fiber optic light guide that transmits light from a remote illuminator.

5. A remote appliance as in claim 3, further comprising a light holding means attached to said camera holding means for holding said light means.

6. A remote appliance as in claim 1, wherein said baseplate has a substantially circular profile.

7. A remote appliance as in claim 1, wherein said bore protection means comprises a bore guard comprising a thin metal band that fits inside the bore and a lip portion that rests on the workpiece at the mouth of the bore.

8. A remote appliance as in claim 1, wherein said baseplate includes a plurality of slotted holes and wherein each said roller is rotatably and adjustably attached to said baseplate by a bolt extending through one of said plurality of slotted holes in said baseplate and by a nut secured to said bolt.

9. A remote appliance as in claim 1, wherein said tool holding means comprises a collar which is pivotally attached to said baseplate, said collar having an inner bore for holding the tool and a set screw for securing the tool in said inner bore.

10. A remote appliance as in claim 1, wherein said camera holding means comprises:

a camera mount adjustably attached to said outer face of said baseplate;

a post having one end adjustably attached to said camera mount and a second end projecting through a camera hole in said baseplate to said inner face side of said baseplate; and a camera tube attached to said second end of said post.

11. A remote appliance as in claim 10, further comprising a shielding lens removable attached to said camera tube for protecting said camera from debris generated by the appliance.

12. A remote appliance for performing work at a worksite on a substantially circular bore of a workpiece and for providing video signals of the worksite to a remote monitor, said bore having a mouth, said remote appliance comprising:

a baseplate having an inner face and an outer face and being adapted to be positioned against the mouth of the bore;

a plurality of rollers, each of said rollers being rotatably and adjustably attached to said inner face of said baseplate and being positioned so as to roll against the bore of the workpiece when said baseplate is positioned against the mouth of the bore so as to enable said appliance to be rotated about said bore in a plane substantially parallel to said baseplate;

a bore protection means for protecting the bore from debris generated by said appliance and from marring by said plurality of rollers;

a tool having a working end;

a tool holding means, adjustably attached to said outer face of said baseplate, for supporting said tool such that said working end of said tool is positioned inwardly of said inner face of said baseplate;

a camera for providing video signals of the worksite to the remote monitor; and a camera holding means, adjustably attached to said outer face of said baseplate, for supporting said camera inwardly of said inner face of said baseplate.

13. A remote appliance as in claim 12, wherein said tool is an air motor.

14. A remote appliance as in claim 13, wherein said working end of said tool comprises a grinding wheel.

15. A remote appliance as in claim 13, wherein said air motor has a throttle and a throttle lock for locking said throttle in an activated position.

16. A remote appliance as in claim 13, wherein said air motor has a rear exhaust port.

17. A remote appliance as in claim 12, further comprising a plurality of roller guards mounted on said baseplate, each of said roller guards surrounding a respective one of said plurality of rollers so as to protect said respective one of said rollers from debris generated by said appliance and being positioned to sweep said debris ahead of said respective one of said rollers as said respective one of said rollers rolls against the bore.

18. A remote appliance as in claim 12, wherein said bore protection means comprises a bore guard comprising a thin metal band that fits inside the bore and a lip portion that rests on the workpiece at the mouth of the bore.

* * * * *